US007362293B2

(12) United States Patent
Chang et al.

(10) Patent No.: US 7,362,293 B2
(45) Date of Patent: Apr. 22, 2008

(54) LOW POWER MULTI-PHASE DRIVING METHOD FOR LIQUID CRYSTAL DISPLAY

(75) Inventors: Yaw-Guang Chang, Tainan (TW); Ming-Cheng Chiu, Tainan (TW)

(73) Assignee: Himax Technologies, Inc., Hsinhua (TW)

( * ) Notice: Subject to any disclaimer, the term of this patent is extended or adjusted under 35 U.S.C. 154(b) by 565 days.

(21) Appl. No.: 11/081,546

(22) Filed: Mar. 17, 2005

(65) Prior Publication Data

US 2006/0208988 A1 Sep. 21, 2006

(51) Int. Cl.
*G09G 3/36* (2006.01)

(52) U.S. Cl. ..... 345/87; 345/204

(58) Field of Classification Search ..... 345/87–100, 345/204

See application file for complete search history.

(56) References Cited

U.S. PATENT DOCUMENTS 5,448,384 A * 9/1995 Uchino et al. ..... 349/33
5,774,099 A * 6/1998 Iwasaki et al. ..... 345/87
5,852,426 A * 12/1998 Erhart et al. ..... 345/96
5,929,847 A * 7/1999 Yanagi et al. ..... 345/204
6,172,663 B1 * 1/2001 Okada et al. ..... 345/96
2002/0109653 A1 8/2002 Kudo et al.
2003/0080934 A1 * 5/2003 Ishiyama ..... 345/100
2004/0021627 A1 * 2/2004 Maki ..... 345/89
2006/0279498 A1 * 12/2006 Kaneda et al. ..... 345/89

* cited by examiner

*Primary Examiner*—Nitin I. Patel
(74) *Attorney, Agent, or Firm*—Birch, Stewart, Kolasch & Birch, LLP

(57) ABSTRACT

A method for driving a display panel is disclosed. At the transitions of scan periods, common and pixel electrode are coupled together to receive one of the power supply voltage and the ground in one phase of a transition, and the common and pixel electrode are further coupled together to receive one of the power supply voltage and the ground in another phase of a consecutive transition, during which the common driver and the source driver of the display panel induce no power consumption.

17 Claims, 7 Drawing Sheets

LOW POWER MULTI-PHASE DRIVING METHOD FOR LIQUID CRYSTAL DISPLAY

BACKGROUND OF THE INVENTION

1. Field of the Invention

The present invention relates to a driving method for liquid crystal display (LCD), and more particularly to a driving method for liquid crystal display wherein a low power consumption is achieved by multi-phase charging sharing.

2. Description of the Prior Art

FIG. 1 shows a typical active matrix LCD. The LCD 100 includes a matrix of rows and columns of display cells. Each display cell includes a TFT (thin film transistor) 104 on an upper substrate 102, wherein the voltage on a source line 108 is coupled to a pixel electrode 105 and charges a storage capacitor (not shown) connected thereto when the TFT 104 being turned on by the voltage on a gate line 107 during a scan period. Each storage capacitor helps to hold the voltage on the pixel electrode 105 when the TFT 104 is turned off beyond the scan period. The voltages on the gate lines 107 and source lines 108 are respectively generated by a gate driver 110 and source driver 106. Besides, a common electrode 112 is disposed on a lower substrate 116 facing the upper substrate 102. A common voltage driver 114 provides a common voltage to the common electrode 112. Thus, molecules of a liquid crystal layer (not shown) sealed between the upper and lower substrates are rotated in response to voltage differences between the source and common electrodes, which determines the brightness or/and color of each display cell.

FIG. 2 shows an equivalent circuit of the matrix of the display cells in the LCD shown in FIG. 1. The same elements in FIGS. 1 and 2 refer to the same symbols for clarity. In each of the display cells, a switch 208 is coupled between the source line 108 and one end of a capacitor 202, and controlled by the voltage signal on the gate line (not shown). The other end of the capacitor 202 is coupled to the common electrode 112. The switch 208 is formed by the TFT 104 shown in FIG. 1 while the capacitor 202 results from the parallel connection of the storage capacitor with a capacitor formed by the pixel electrode 105, liquid crystal (LC) layer and the common electrode 112. In each column of the display cells, a parasitic capacitor 302 is formed between the common electrode 112 and the source line 108.

FIG. 3 shows waveforms of a common and source voltage respectively on the common electrode 112 and source line 108 of one of the display cells shown in FIG. 2 during three consecutive scan periods in a traditional line inversion driving method. The common voltage Vcom is alternately pulled up and down to the high common voltage level $V_{COMH}$ and the low common voltage level $V_{COML}$ at each transition of scan periods. The transition period $D_1$ starts from the middle of the first scan period and ends at the middle of the second scan period while the transition period $D_2$ starts from the middle of the second scan period and ends at the middle of the third scan period. The voltages $V_{COMH}$ and $V_{COML}$ are provided by directly pumping a power supply voltage $V_{CI}$ up to $2V_{CI}$ or down to $-V_{CI}$ through a DC/DC pumping circuit, wherein the power supply voltage is derived from a current source driver. The source voltage Vs is pulled by the (data) signal on the source line 108 to corresponding levels for generation of desired voltage differences $+V_b$, $-V_a$ and $+V_c$ between the source and common electrodes of the display cell respectively during the three scan periods.

The power consumption P, resulting from each scan period transition of one display cell, of the source or common voltage driver is $V_{DD}\times I$, where $V_{DD}$ is the voltage supplied by the source or common voltage driver, and $I_{AVG}$ is the average current drawn from the source or common voltage driver during the transition period D1 or D2 (having the same length of the scan period). Since the equivalent load of each display cell is dominated by the parasitic capacitor $C_{load}$, the average current $I_{AVG}$ is approximately equal to the current flowing through the parasitic capacitor $C_{load}$ and is derived by the equation:

$$I_{AVG}=C_{load}\times V_w\times F \tag{1}$$

where $V_w$ is the difference between the voltages across the parasitic capacitor $C_{load}$ before and after the transition, and F is the scan rate (reciprocal of one scan period). Further, the voltage difference $V_w$ is derived by the equation:

$$V_w=V_{POS}+|V_{NEG}| \tag{2}$$

where $V_{POS}$ is the positive one of the voltages across the parasitic capacitor $C_{load}$ before and after the transition, and the $V_{NEG}$ is the negative one. Therefore, the power consumption P is derived by the following equation:

$$P=V_{DD}\times C_{load}\times(V_{POS}+|V_{NEG}|)\times F \tag{3}$$

Accordingly, during the transition period $D_1$, the power consumption is $2V_{CI}\times C_{load}\times(V_a+V_b)\times F$. During the transition period $D_2$, the power consumption is $3V_{CI}\times C_{load}\times(V_a+V_c)\times F$. Thus, for the scan period starting from the middle of the transition period $D_1$ and ending at the middle of the transition period $D_2$, the average power consumption $P_{total}$ is derived by the equation:

$$P_{total}=\tfrac{1}{2}\times 2V_{CI}\times C_{load}\times(V_a+V_b)\times F+\tfrac{1}{2}\times 3V_{C1}\times C_{load}\times(V_a+V_c)\times F \tag{4}$$

However, such a power consumption is relatively large. A power-saving driving method is necessary for improvement of the display device.

SUMMARY OF THE INVENTION

Accordingly, it is an object of the present invention to provide an improved line inversion driving method for liquid crystal display to save more power by multi-phase charging sharing.

It is another object of the present invention to provide a method for driving a display panel wherein no power consumption of the common driver and the source driver of the display panel is induced during portions of the scan periods.

In accordance with the present invention, a low power multi-phase driving method for display panel is disclosed. In one embodiment, the common electrode is pulled to one of a first and second voltage level both provided by pumping a power supply voltage, and the pixel electrode is pulled to corresponding voltage levels for generation of the desired voltage differences for each display cell of the display panel. At the transitions of the scan periods, the common and pixel electrode are coupled together to receive the power supply voltage in one of several phases of the transition. Further, the common and pixel electrode are further coupled together to ground in another phase of the transition. In another embodiment, the common electrode is further coupled to the first voltage level while the voltage difference between the pixel electrode and the common electrode remains identical due to the charge holding across the corresponding parasitic capacitor of the display panel.

BRIEF DESCRIPTION OF THE DRAWINGS

The objectives, features of the present invention as well as the advantages thereof can be best understood through the following preferred embodiments and the accompanying drawings, wherein.

DESCRIPTION OF THE PREFERRED EMBODIMENT

The invention will be explained in detail in accordance with the accompanying drawings. It is necessary to illustrate that the drawings below could be in simplified forms and not drawn in proportion to the real cases. Further, the dimensions of the drawings are enlarged for explaining and understanding more clearly.

Figure 1:
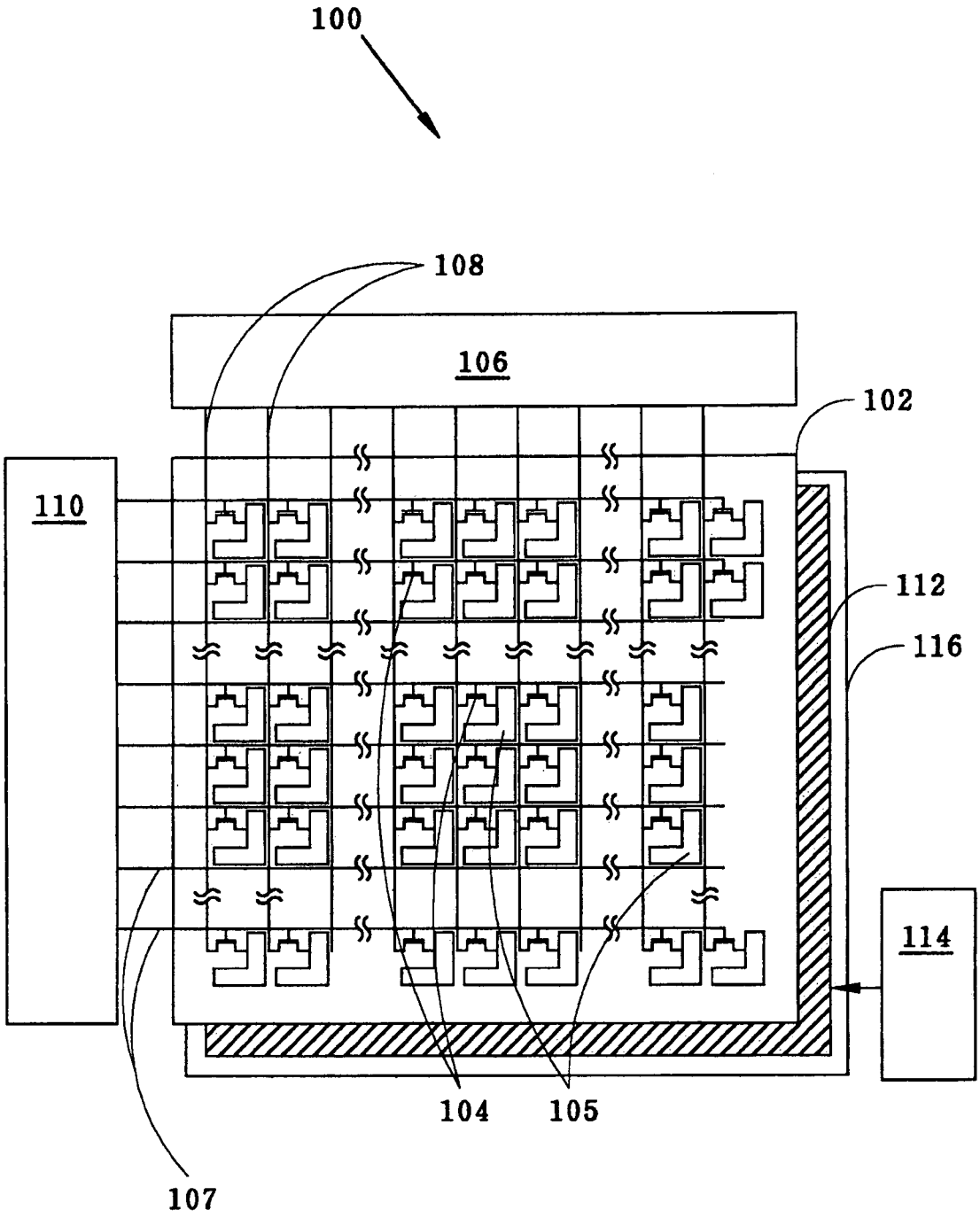
FIG.1(Prior Art)
FIG. 1 shows a conventional active matrix LCD.
Figure 2:
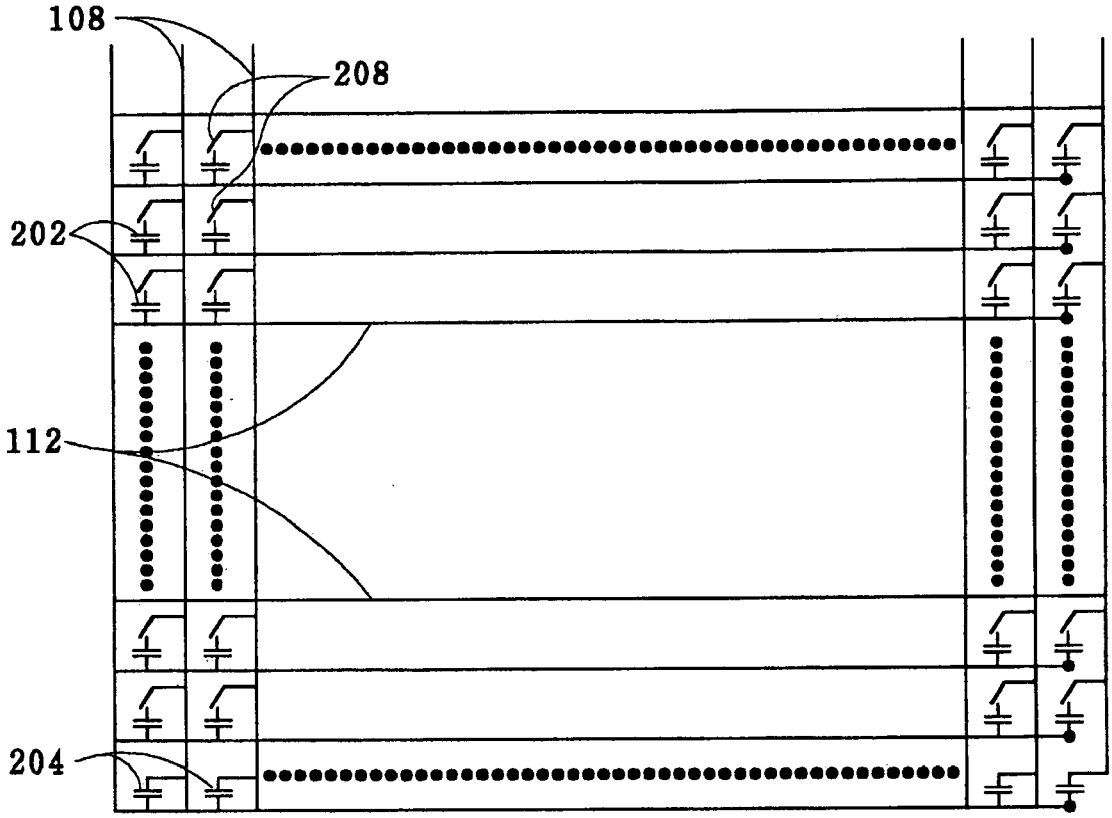
FIG.2(Prior Art)
FIG. 2 shows an equivalent circuit of the matrix of the display cells in the LCD shown in FIG. 1.
Figure 4:
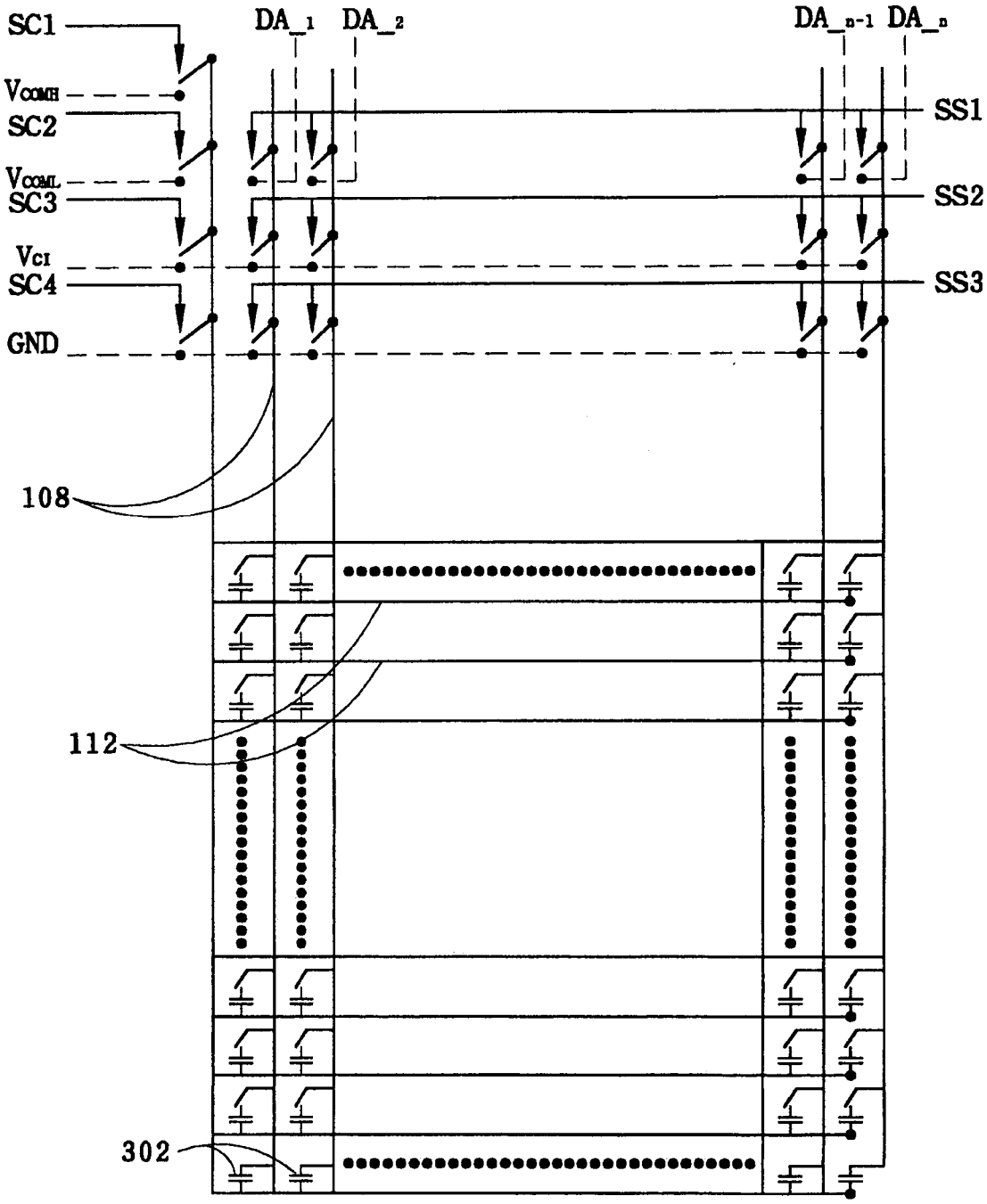
FIG. 4 shows a display device according to one embodiment of the invention.

FIG. 4 shows a display device according to one embodiment of the invention. The same elements in FIGS. 2 and 4 refer to the same symbols for clarity. The switches controlled by the signals SC1, SC2, SC3 and SC4 are coupled between the common electrode 112 and nodes receiving the voltages $V_{COMH}$, $V_{COML}$, $V_{CI}$ and a ground voltage GND, respectively. Each of the switches controlled by the signal SS1 is coupled between the source line 108 and a node receiving one of the voltages (data signals) DA_1, DA_2, . . . and DA_n. Each of the switches controlled by the signal SS2 is coupled between the source line 108 and a node receiving the voltage $V_{CI}$. Each of the switches controlled by the signal SS3 is coupled between the source line 108 and ground.

Figure 3:
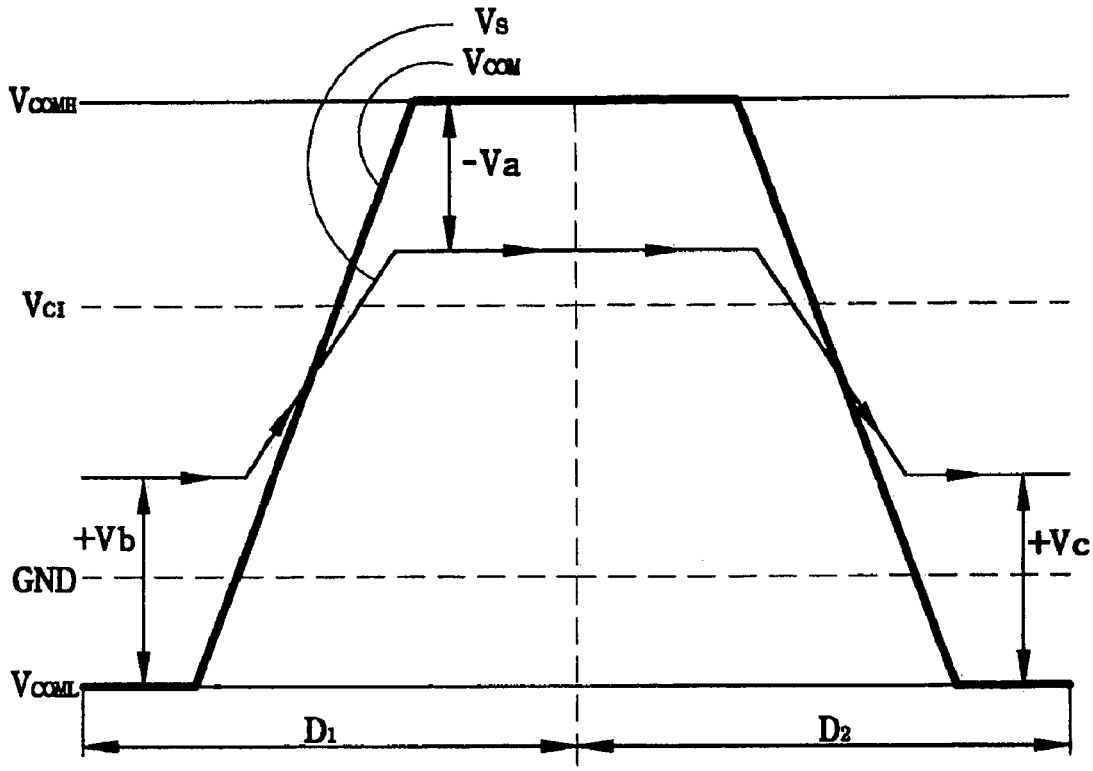
FIG.3(Prior Art)
FIG. 3 shows waveforms of a common and source voltage respectively on the common electrode and source line of one of the display cells shown in FIG. 2.
Figure 5:
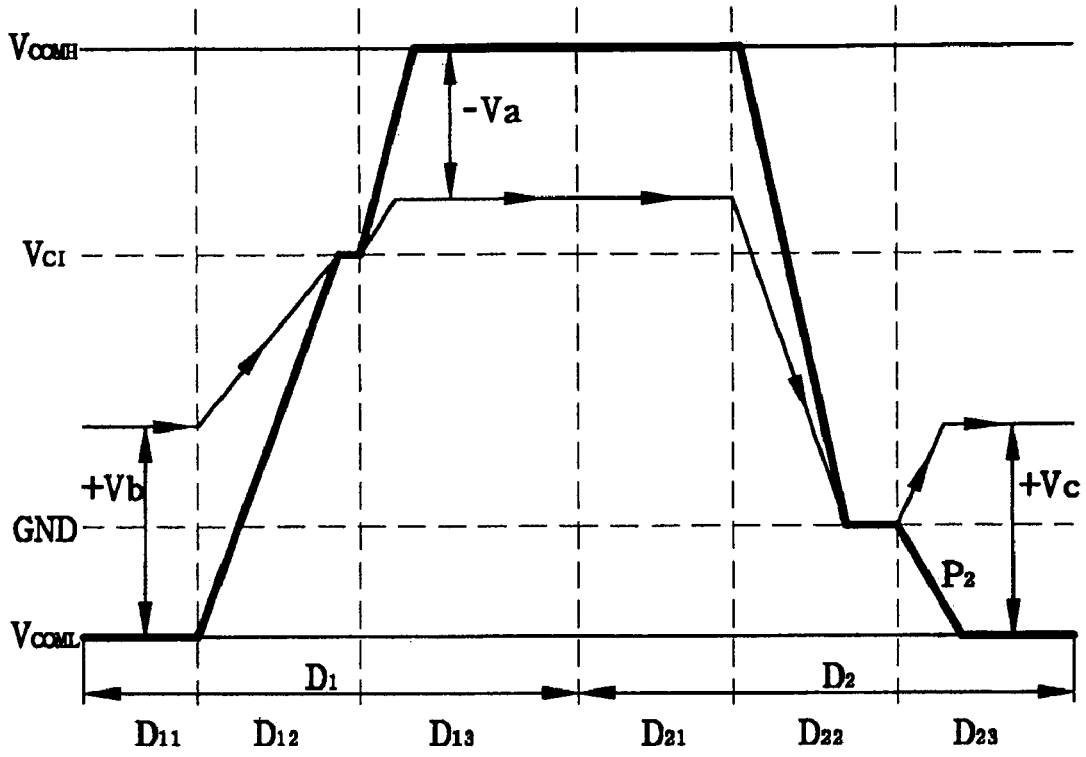
FIG. 5 shows waveforms of a common and source voltage respectively on the common electrode and source line of one of the display cells shown in FIG. 4 according to one embodiment of the invention.

FIG. 5 shows waveforms of the common and source voltage respectively on the common electrode 112 and source line 108 of one of the display cells in the display device shown in FIG. 4 during three consecutive scan periods in a line inversion driving method according to one preferred embodiment of the invention. Similarly to FIG. 3, the common voltage Vcom is pulled up and down to $V_{COMH}$ and $V_{COML}$ during the two consecutive transition periods $D_1$ and $D_2$, respectively. The source voltage Vs is pulled by the signal DA_1, DA_2, . . . or DA_n on the source line 108 to corresponding levels for generation of desired voltage differences $+V_b$, $-V_a$ and $+V_c$ between the source and common electrodes of the display cell respectively during the three scan periods. It is noted that the transition period $D_1$ is composed of 3 phases $D_{11}$, $D_{12}$ and $D_{13}$, and the transition period $D_2$ is composed of 3 phases $D_{21}$, $D_{22}$ and $D_{23}$.

Initially, during the phase $D_{11}$, only the two switches controlled by the signals SC2 and SS1 are closed, whereby the voltages Vcom and Vs are $V_{COML}$ and $V_{COML}+V_b$. During the phase $D_{12}$, the two switches controlled by the signals SC2 and SS1 are opened while those controlled by the signals SC3 and SS2 are closed so that the source line 108 and common electrode 112 are coupled together to receive the voltage $V_{CI}$, whereby the voltages Vcom and Vs are pulled up to $V_{CI}$. During the phase $D_{13}$, the two switches controlled by the signals SC3 and SS2 are opened while those controlled by the signals SC1 and SS1 are closed so that the source line 108 and common electrode 112 are respectively coupled to receive the voltages $V_{COMH}$ and the corresponding signal DA_1, DA_2, . . . or DA_n, whereby the voltages Vcom and Vs are pulled to $V_{COMH}$ and $V_{COMHL}-V_a$.

During the phase $D_{21}$, the switches controlled by the signals SC1 and SS1 stay closed and the voltages Vcom and Vs remain at $V_{COMH}$ and $V_{COMH}-V_a$. During the phase $D_{22}$, the two switches controlled by the signals SC1 and SS1 are opened while those controlled by the signals SC4 and SS3 are closed so that the common electrode 112 and the source line 108 are coupled together to the ground, whereby the voltages Vcom and Vs are pulled down to GND. During the phase $D_{23}$, the two switches controlled by the signals SC4 and SS3 are opened while those controlled by the signals SC2 and SS1 are closed so that the common electrode 112 and the source line 108 are coupled to receive the voltages $V_{COML}$ and the corresponding data signal DA_1, DA_2, . . . or DA_n, whereby the voltages Vcom and Vs are pulled to $V_{COML}$ and $V_{COML}+V_C$.

It is noted that no power consumption of the common voltage or source driver is induced during the phases $D_{12}$ and $D_{22}$ although the voltages Vcom and Vs are varied. This is because, during the phases $D_{12}$ and $D_{22}$, the source and common electrodes are coupled together, which results in a voltage difference of zero therebetween. Thus, the average power consumption $P_{total}$ during the scan period starting from the middle of the transition period $D_1$ and ending at the middle of the transition period $D_2$ is derived by the equation:

$$P_{total}=\tfrac{1}{2}\times P_{D13}+\tfrac{1}{2}\times P_{D23} \tag{5}$$

where $P_{D13}$ and $P_{D23}$ are the power consumptions during the phases $D_{13}$ and $D_{23}$ respectively. Further, according to the equation (3), the average power consumption $P_{total}$ is derived by:

$$P_{total}=\tfrac{1}{2}\times 2V_{CI}\times C_{load}\times V_a\times F+\tfrac{1}{2}\times 3V_{CI}\times C_{load}\times V_c\times F \tag{6}$$

By comparison of the equations (4) and (6), it is noted that the average power consumption in the previously described embodiment is less than that in the prior art. For example, when $V_{COMH}$=4.5V, $V_{COML}$=1V, $V_{CI}$=2.8V, $V_a$=2.3V, $V_b$=3.2V and $V_c$=2.3V, the average power consumption caused by the traditional line inversion driving method is 13.75 $C_{load}\times F$ while that caused by the previously described line inversion driving method is 7.1$C_{load}\times F$.

Figure 6:
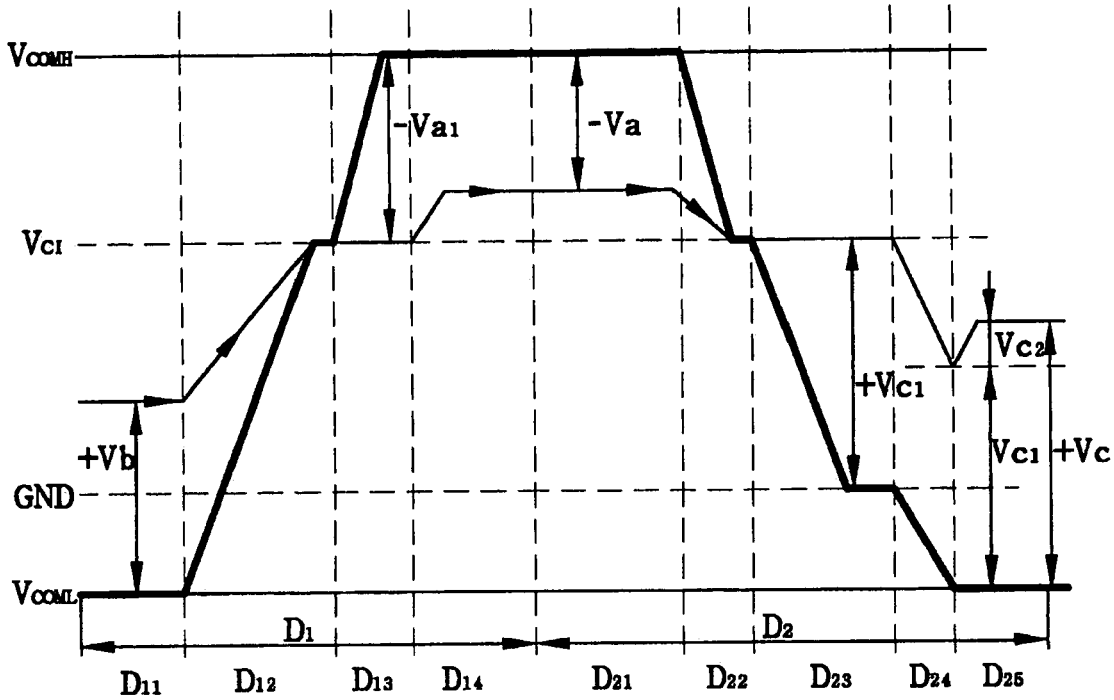
FIG. 6 shows waveforms of a common and source voltage respectively on the common electrode and source line of one of the display cells shown in FIG. 4 according to another embodiment of the invention.

FIG. 6 shows waveforms of the common and source voltage respectively on the common electrode 112 and source line 108 of one of the display cells in the display device shown in FIG. 4 during three consecutive scan periods in a line inversion driving method according to another embodiment of the invention. Similarly to FIG. 5, the common voltage Vcom is pulled up and down to $V_{COMH}$ and $V_{COML}$ during the two consecutive transition periods $D_1$ and $D_2$, respectively. The source voltage Vs is pulled by the signal DA_1, DA_2, . . . or DA_n on the source line 108 to corresponding levels for generation of desired voltage difference $+V_b$, $-V_a$ and $+V_c$ between the source and common electrodes of the display cell respectively during the three scan periods. It is noted that the transition period $D_1$ is composed of 4 phases $D_{11}$, $D_{12}$, $D_{13}$ and $D_{14}$, and the transition period $D_2$ is composed of 5 phases $D_{21}$, $D_{22}$, $D_{23}$, $D_{24}$ and $D_{25}$.

Initially, during the phase $D_{11}$, only the two switches controlled by the signals SC2 and SS1 are closed, whereby the voltage Vcom and Vs are $V_{COML}$ and $V_{COML}+V_b$. During the phase $D_{12}$, the two switches controlled by the signal SC2 and SS1 are opened while those controlled by the signals SC3 and SS2 are closed so that the source line 108 and common electrode 112 are coupled together to receive the voltage $V_{CI}$, whereby the voltages Vcom and Vs are pulled up to $V_{CI}$. During the phase $D_{13}$, the switch controlled by the signal SC3 is opened and the switches controlled by the signal SS2 stay closed while the switch controlled by the signal SC1 is closed, whereby the voltage Vcom is pulled to $V_{COMH}$ and the voltage Vs remains at $V_{CI}$. During the phase $D_{14}$, the switch controlled by the SC1 stays closed and the switches controlled by the signal SS2 are open while the switches controlled by the signal SS1 are closed and the source lines 108 are coupled to receive the corresponding signal DA_1, DA_2, . . . or DA_n, whereby the voltage Vcom remains at $V_{COMH}$ and Vs are pulled to $V_{COML}-V_a$.

During the phase $D_{21}$, the switches controlled by the signals SC1 and SS1 stay closed and the voltages Vcom and Vs remain at $V_{COMH}$ and $V_{COML}-V_a$. During the phase $D_{22}$, the two switches controlled by the signals SC1 and SS1 are opened while those controlled by the signals SC3 and SS2 are closed so that the common electrode 112 and the source line 108 are coupled together to receive the voltage $V_{CI}$, whereby the voltages Vcom and Vs are pulled down to $V_{CI}$. During the phase $D_{23}$, the switches controlled by the signal SS2 stay closed and the switch controlled by the signal SC3 is opened while the switch controlled by the signal SC4 is closed so that the common electrode 112 is coupled to the ground, whereby the voltage Vcom is pulled down to GND and the voltage Vs remains at $V_{CI}$. During the phase $D_{24}$, the switches controlled by the signal SS2 and SC4 are opened while the switch controlled by the SC2 is closed so that the common electrode 112 is coupled to receive the voltage $V_{COML}$, whereby the voltage Vcom is pulled to $V_{COML}$ and the voltage Vs is accordingly pulled down to $V_{COML}+V_{CI}$ since the voltage across the parasitic capacitor still holds at $V_{CI}$. During the phase $D_{25}$, the switch controlled by the SC2 stays closed while the switches controlled by the signal SS1 are closed so that the voltage Vcom remains at $V_{COML}$ and the source lines 108 are coupled to received the corresponding signal DA_1, DA_2, . . . or DA_n, whereby the voltage Vcom and Vs are pulled to $V_{COML}$ and $V_{COML}+V_C$, wherein the sum of the $V_{c1}$ and $V_{c2}$ is equal to $V_C$ as shown in FIG. 6.

It is noted that no power consumption of the common driver or source driver is induced during the phases $D_{12}$, $D_{22}$ as well as $D_{24}$ although the voltage Vcom and Vs are varied. This is because, during the phases $D_{12}$ and $D_{22}$, the source and common electrodes are coupled together, which results in a voltage difference of zero therebetween, while during the phase $D_{24}$, the common voltage Vcom is pulled to $V_{COML}$, as well as the source line is decoupled from any charging operation, thereby the source voltage Vs would accordingly change from $V_{CI}$ to $V_{COML}+V_{C1}$ along with the variation of the common voltage Vcom from GND to $V_{COML}$, which does not consume any extra power. Thus, the average power consumption $P_{total}$ during the scan period starting from the middle of the transition period $D_1$ and ending at the middle of the transition period $D_2$ is derived by the equation:

$$P_{total}=\tfrac{1}{2}\times(P_{D13}+P_{D14})+\tfrac{1}{2}\times(P_{D23}+P_{D25}) \tag{7}$$

where $P_{D13}$, $P_{D14}$, $P_{D23}$ and $P_{D25}$ are the power consumptions during the phases $D_{13}$, $D_{14}$, $D_{23}$ and $D_{25}$ respectively. It is noted that, during the phase $D_{13}$, for the reason that the source voltage Vs is at $V_{CI}$ and the common voltage is pulled to $2V_{CI}$ (i.e., $V_{COMH}$), the charging current within the $C_{load}$ would flow from the common electrode to the pixel electrode, in other words, a power energy $P_{RE}=\{\tfrac{1}{2}\times(2V_{CI}-V_{CI})\times C_{load}\times V_{a1}\times F\}$ would be charged back to the power supply coupled to the pixel electrode. So, as the whole concerned, the actual total power consumption during the phase $D_{13}$ is equal to $P_{D13}-P_{RE}=\tfrac{1}{2}\times V_{CI}\times C_{load}\times V_{a1}\times F$, where $V_{a1}$ is equal to $V_{CI}$. Besides, it is also noted that, during the phase $D_{23}$, since the common voltage Vcom finally reaches GND and the source voltage is at $V_{CI}$, which is just equal to the power supply voltage, the charging operation to make the voltage across the capacitor $C_{load}$ from 0 to $+V_{c1}$ is mainly driven by the source voltage ($V_{CI}$) and that is like the power supply directly charges the capacitor $C_{load}$ through the source electrode without any pumping operation. Thus, the equivalent power consumption during the phase $D_{23}$ is equal to $P_{D23}=\tfrac{1}{2}\times V_{CI}\times C_{load}\times V_{c1}\times F$, where $V_{c1}$ is equal to $V_{CI}$. Further, according to equation (6), the average power consumption $P_{total}$ in this embodiment is derived by:

$$P_{total}=\tfrac{1}{2}\times 2V_{CI}\times C_{load}\times V_a\times F+\tfrac{1}{2}\times V_{CI}\times C_{load}\times V_{a1}\times F+\tfrac{1}{2}\times V_{CI}\times C_{load}\times V_{c1}\times F+\tfrac{1}{2}\times 3V_{CI}\times C_{load}\times V_c\times F \tag{8}$$

Similarly, by comparison of the equations (4), (6) and (8), it is noted that the average power consumption in the second embodiment described above is less than that in the prior art and even less than that in the first embodiment earlier described. For example, when $V_{COMH}$=4.5V, $V_{COML}$=1V, $V_{CI}$=2.8V, $V_a$=2.3V, $V_b$=3.2V and $V_c$=2.3V, the average power consumption caused by the previously described line inversion driving method in FIG. 6 is 3.85 $C_{load}\times F$ while that caused by the first embodiment is 7.1$C_{load}\times F$ and that caused by the traditional line inversion driving method is 13.75 $C_{load}\times F$.

Figure 7:
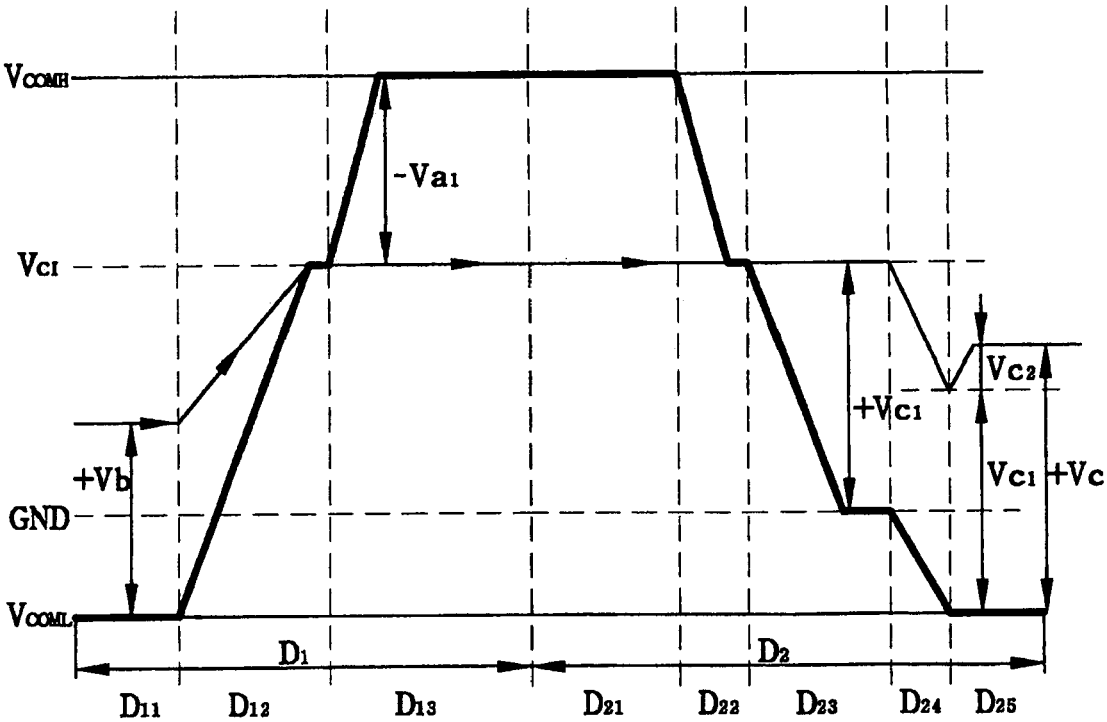
FIG. 7 shows a first special case of the second embodiment in FIG. 6.

FIG. 7 shows a first special case of the second embodiment in FIG. 6. The first special case is applicable when the value of the desired voltage difference $-V_a$ is equal to the voltage difference between the common voltage $V_{COMH}$ and the power supply voltage $V_{CI}$. The line inversion driving method of the first special case in FIG. 7 is the same as that in FIG. 6 except that no phase $D_{14}$ exists in the first special case. As the phase $D_{14}$ is no longer required, and therefore the average power consumption could be further conserved.

Figure 8:
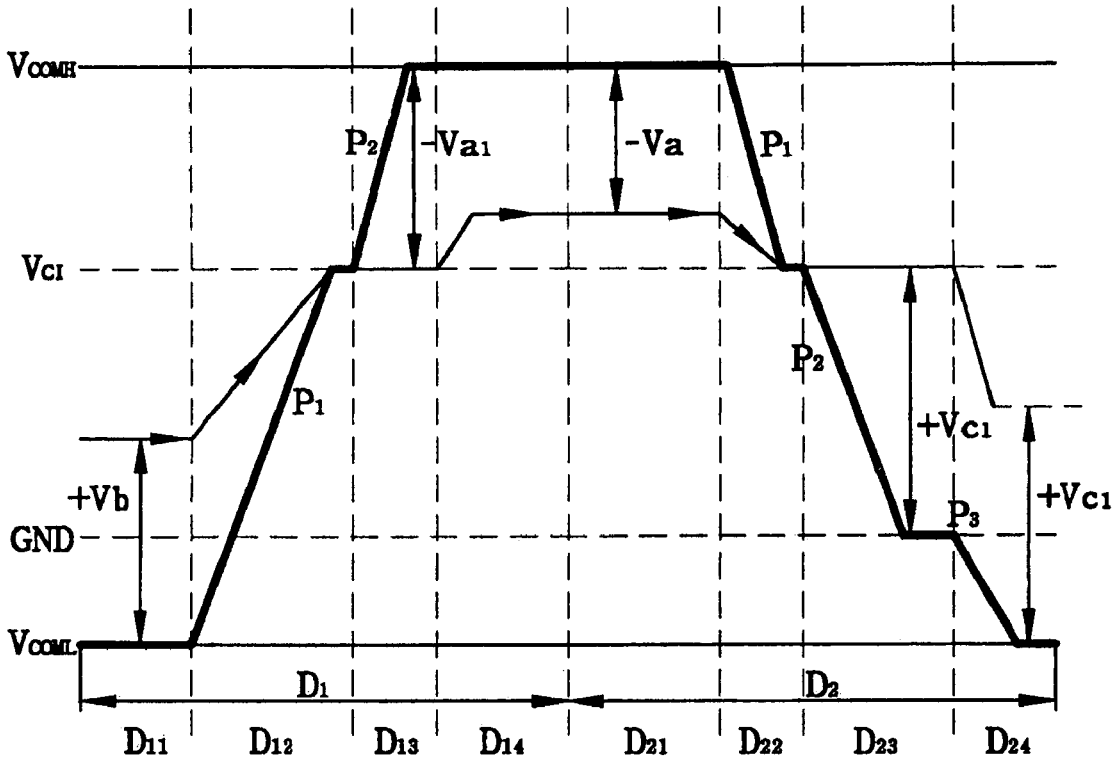
FIG. 8 shows a second special case of the second embodiment in FIG. 6.

FIG. 8 shows a second special case of the second embodiment in FIG. 6. The second special case is applicable when the value of the desired voltage difference $V_{c1}$ is equal to the voltage difference between the power supply voltage $V_{CI}$ and the ground level GND (that is, $V_{CI}$) as shown in FIG. 8. The line inversion driving method of the second special case in FIG. 8 is the same as that in FIG. 6 except that no phase $D_{25}$ exists in the second special case. As the phase $D_{25}$ is no longer required, and therefore the average power consumption could be further conserved. Specifically, in FIG. 8, during the phase $D_{24}$, after the source voltage Vs is naturally pulled down to the $V_{COML}+V_{CI}$ and the common voltage Vcom is pulled to $V_{COML}$, the source voltage Vs would be maintained at $V_{COML}+V_{CI}$ (as the dotted line shown) without any charging operation due to the fact that the voltage across the capacitor still hold at $V_{c1}$ (or $V_{CI}$) at this time. Thus, the average power consumption caused by the phase $D_{25}$ of the second embodiment would be conserved in the second special case.

For the discussion described above, the present invention provides a low power multi-phase driving method for liquid crystal display, wherein the transition of the scan periods is divided into several phases through temporarily coupling the pixel electrode and the common electrode together to receive the power supply voltage or to the ground level as well as pulling the source voltage and the common voltage to different voltage levels. Accordingly, the present invention conserves a great deal of power compared to the traditional method.

Although specific embodiments have been illustrated and described, it will be obvious to those skilled in the art that various modifications may be made without departing from the spirit which is intended to be limited solely by the appended claims.

What is claimed is:

1. A method for driving a display panel having an array of display cells wherein brightness of each display cell is determined by desired voltage differences between a pixel and common electrode during a plurality of scan periods, the method comprising the steps of:

at transitions of the scan periods, pulling a voltage on the common electrode to one of a first and second voltage level both provided by pumping a power supply voltage, and pulling a voltage on the pixel electrode to corresponding voltage levels for generation of the desired voltage differences for each display cell; and wherein the common and pixel electrode are coupled together to receive the power supply voltage in one of a plurality phases of the transition.

2. The method according to claim 1, wherein said common and pixel electrode are further coupled together to ground in another of the plurality phases of a consecutive transition.

3. The method according to claim 1, wherein said first voltage level is provided by pumping the power supply voltage down to minus the power supply voltage, and said second voltage level is provided by pumping the power supply voltage up to two times the power supply voltage.

4. The method according to claim 1, wherein said plurality of phases of the transition comprise three phases during which the common electrode is pulled from the first voltage level to the second voltage level higher than the first voltage level:

a first phase wherein the common electrode is coupled to receive the first voltage level, and the pixel electrode is coupled to receive corresponding voltage levels for generation of the desired voltage differences for each display cell;

a second phase wherein the common and pixel electrode are coupled together to receive the power supply voltage; and a third phase wherein the common electrode is coupled to receive the second voltage level, and the pixel electrode is coupled to receive corresponding voltage levels for generation of the desired voltage differences for each display cell.

5. The method according to claim 4, wherein said plurality of phases of a consecutive transition comprises three phases during which the common electrode is pulled from the second voltage level to the first voltage level lower than the second voltage level:

a first phase wherein the common electrode is coupled to receive the second voltage level, and the pixel electrode is coupled to receive corresponding voltage levels for generation of the desired voltage differences for each display cell;

a second phase wherein the common and pixel electrode are coupled together to ground; and a third phase wherein the common electrode is coupled to receive the first voltage level, and the pixel electrode is coupled to receive corresponding voltage levels for generation of the desired voltage differences for each display cell.

6. The method according to claim 1, wherein said common and pixel electrode are further coupled together to the power supply voltage in another of the plurality phases of a consecutive transition.

7. The method according to claim 6, wherein said common electrode is further coupled to ground and the pixel electrode is coupled to the power supply voltage in another of the plurality phases of the consecutive transition.

8. The method according to claim 7, wherein said common electrode is further coupled to the first voltage level while the voltage difference between the pixel electrode and the common electrode remains identical due to charge holding across a corresponding parasitic capacitor.

9. The method according to claim 1, wherein said plurality of phases of the transition comprise four phases during which the common electrode is pulled from the first voltage level to the second voltage level higher than the first voltage level:

a first phase wherein the common electrode is coupled to receive the first voltage level, and the pixel electrode is coupled to receive corresponding voltage levels for generation of the desired voltage differences for each display cell;

a second phase wherein the common and pixel electrode are coupled together to receive the power supply voltage;

a third phase wherein the common electrode is coupled to receive the second voltage level, and the pixel electrode is coupled to the power supply voltage; and a fourth phase wherein the common electrode is coupled to the second voltage level, and the pixel electrode is coupled to receive corresponding voltage levels for generation of the desired voltage differences for each display cell.

10. The method according to claim 9, wherein said plurality of phases of a consecutive transition comprise five phases during which the common electrode is pulled from the second voltage level to the first voltage level lower than the second voltage level:

a first phase wherein the common electrode is coupled to the second voltage level, and the pixel electrode is coupled to receive corresponding voltage levels for generation of the desired voltage differences for each display cell;

a second phase wherein the common and pixel electrode are coupled together to the power supply voltage;

a third phase wherein the common electrode is coupled to the ground and the pixel electrode is coupled to the power supply voltage;

a fourth phase wherein the common electrode is coupled to the first voltage level while the voltage difference between the pixel electrode and the common electrode remains identical due to charge holding across a corresponding parasitic capacitor; and a fifth phase wherein the common electrode is coupled to the first voltage level, and the pixel electrode is coupled to receive corresponding voltage levels for generation of the desired voltage differences for each display cell.

11. The method according to claim 1, wherein said plurality of phases of the transition comprise three phases during which the common electrode is pulled from the first voltage level to the second voltage level higher than the first voltage level:

a first phase wherein the common electrode is coupled to receive the first voltage level, and the pixel electrode is coupled to receive corresponding voltage levels for generation of the desired voltage differences for each display cell;

a second phase wherein the common and pixel electrode are coupled together to receive the power supply voltage; and a third phase wherein the common electrode is coupled to receive the second voltage level, and the pixel electrode is coupled to the power supply voltage.

12. The method according to claim 11, wherein said plurality of phases of a consecutive transition comprise five phases during which the common electrode is pulled from the second voltage level to the first voltage level lower than the second voltage level:

a first phase wherein the common electrode is coupled to the second voltage level, and the pixel electrode is coupled to the poser supply voltage;

a second phase wherein the common and pixel electrode are coupled together to the power supply voltage;

a third phase wherein the common electrode is coupled to the ground and the pixel electrode is coupled to the power supply voltage;

a fourth phase wherein the common electrode is coupled to the first voltage level while the voltage difference between the pixel electrode and the common electrode remains identical due to charge holding across a corresponding parasitic capacitor; and a fifth phase wherein the common electrode is coupled to the first voltage level, and the pixel electrode is coupled to receive corresponding voltage levels for generation of the desired voltage differences for each display cell.

13. The method according to claim 1, wherein said plurality of phases of the transition comprise four phases during which the common electrode is pulled from the first voltage level to the second voltage level higher than the first voltage level:

a first phase wherein the common electrode is coupled to receive the first voltage level, and the pixel electrode is coupled to receive corresponding voltage levels for generation of the desired voltage differences for each display cell;

a second phase wherein the common and pixel electrode are coupled together to receive the power supply voltage;

a third phase wherein the common electrode is coupled to receive the second voltage level, and the pixel electrode is coupled to the power supply voltage; and a fourth phase wherein the common electrode is coupled to the second voltage level, and the pixel electrode is coupled to receive corresponding voltage levels for generation of the desired voltage differences for each display cell.

14. The method according to claim 13, wherein said plurality of phases of a consecutive transition comprise four phases during which the common electrode is pulled from the second voltage level to the first voltage level lower than the second voltage level:

a first phase wherein the common electrode is coupled to the second voltage level, and the pixel electrode is coupled to receive corresponding voltage levels for generation of the desired voltage differences for each display cell;

a second phase wherein the common and pixel electrode are coupled together to the power supply voltage;

a third phase wherein the common electrode is coupled to the ground and the pixel electrode is coupled to the power supply voltage; and a fourth phase wherein the common electrode is coupled to the first voltage level while the voltage difference between the pixel electrode and the common electrode remains identical due to charge holding across a corresponding parasitic capacitor.

15. A method for driving a display panel having an array of display cells wherein brightness of each display cell is determined by desired voltage differences between a pixel and common electrode during, a plurality of scan periods, the method comprising the steps of:

at transitions of the scan periods, pulling a voltage on the common electrode to one of a first and second voltage level, and pulling a voltage on the pixel electrode to corresponding voltage levels for generation of the desired voltage differences for each display cell; and wherein the common and pixel electrode are coupled together to receive one of the power supply voltage and ground in one transition of the scan periods, and the common and pixel electrode are further coupled together to receive one of the power supply voltage and the ground in a consecutive transition of the scan periods, during which a common driver and a source driver induce no power consumption.

16. The method according to claim 15, wherein said common electrode is further coupled to the first voltage level while the voltage difference between the pixel electrode and the common electrode remains identical due to charge holding across a corresponding parasitic capacitor.

17. The method according to claim 15, wherein said first voltage level is provided by pumping the power supply voltage down to minus the power supply voltage, and said second voltage level is provided by pumping the power supply voltage up to two times the power supply voltage.

* * * * *